United States Patent [19]

Quevedo

[11] 4,378,814

[45] Apr. 5, 1983

[54] HAIR CURLING DEVICE

[76] Inventor: Humberto Quevedo, 323 W. 43rd St., New York, N.Y. 10036

[21] Appl. No.: 267,861

[22] Filed: May 28, 1981

[51] Int. Cl.[3] ..... A45D 2/00

[52] U.S. Cl. ..... 132/40; 132/33 D; 132/34 B

[58] Field of Search ..... 132/38–44, 132/33 R, 33 D, 33 F, 34 A, 34 B, 34 C, 46 A

[56] References Cited

U.S. PATENT DOCUMENTS

| | | | |
|---|---|---|---|
| 2,754,832 | 7/1956 | Garland | 132/43 R |
| 2,796,872 | 6/1957 | Mussy | 132/40 |
| 3,064,659 | 11/1962 | Solomon | 132/40 |
| 3,913,593 | 10/1975 | Sato | 132/40 |
| 4,234,001 | 11/1980 | Morefield | 132/40 |

FOREIGN PATENT DOCUMENTS

| | | | |
|---|---|---|---|
| 579290 | 7/1958 | Italy | 132/40 |

*Primary Examiner*—Robert A. Haffer

*Attorney, Agent, or Firm*—Evelyn M. Sommer

[57] ABSTRACT

The subject invention relates to a new and improved roller to produce curls in a strand of hair. More particularly, an improved hair roller is disclosed which includes a longitudinally extending body having an irregular cross section. In use, a strand of hair is wound around the body in a helical manner along the length thereof such that the diameter of successive turns varies. By this arrangement, when the strand is unwound, curls having various curvatures are formed. In the preferred embodiment of the subject invention, the roller includes an intermediate solid body having an oblate spheroid configuration. In addition, two sets of rods are provided which extend axially away from the opposed ends of the spheroid each terminating in a flange portion. Each set of rods is spaced apart to define a cross sectional diameter which is less than the maximum diameter of the intermediate solid body. A plurality of rollers may be utilized to create a naturally curly hair style.

8 Claims, 5 Drawing Figures

HAIR CURLING DEVICE

BACKGROUND OF THE INVENTION

The present invention relates to a new and improved device for imparting curls to a strand of hair. More particularly, an improved hair roller is disclosed which includes a longitudinally extending body having an irregular cross section. In use, a strand of hair is wound around the body in a helical manner such that the diameter of successive turns varies. By this arrangement, curls having various curvatures can be formed along the length of a single strand of hair.

In the prior art, a variety of hair rollers have been used for imparting curls to straight strands of hair. More particularly, both professional hair stylists and individuals have used hair rollers to alter the shape and configuration of straight hair to approximate the appearance of natural curls. Most prior art hair rollers have an elongated cylindrical configuration and may be solid or hollow. In use, the hair is separated into groups of strands, with each group of strands being tightly wrapped around the exterior cylindrical surface of the roller. The wrapped strand is then secured in a fixed position relative to the roller by any suitable means such as a bobby pin. When the strand is unwrapped from the roller after a suitable period of time, curls will be formed along the length thereof.

The size and curvature of the curls which are formed correspond directly to the cross sectional diameter of the roller used. More particularly, if larger curls are desired, rollers having a larger diameter are utilized. Similarly, if relatively smaller curls are desired, rollers having a smaller diameter are utilized.

When creating a hair style with rollers, the user generally attempts to approximate the appearance of naturally curly hair. As can be appreciated, naturally curly hair, rather then having curls of uniform size and curvature, has a wide variety of different sized curls. Accordingly, in order to approximate the natural appearance, the user will employ many different sized rollers when styling the hair. More particularly, by wrapping various strands of hair around rollers having different diameters, the resulting hair style can be provided with curls having various curvatures. Unfortunately, the aesthetic appearance achieved by this technique is not entirely satisfactory, since all the curls formed in each wrapped strand have an identical curvature. Different curvatures can only be formed in different strands using different rollers. In contrast, in a naturally curly hair style, the shape and size of the curls is random. Another shortcoming of the prior art technique is the necessity of providing a variety of different diameter rollers. Not only does this required variety increase the cost of a set of curlers, but in addition, the user must carefully select the proper roller for each strand of hair in an attempt to achieve a natural appearance.

Accordingly, it is an object of the subject invention to provide a new and improved roller which is capable of producing curls having various curvatures in a single strand of hair.

It is another object of the subject invention to provide a new and improved roller which is easier to use.

It is a further object of the subject invention to provide a new and improved roller which can be used to produce a more naturally curly hair style.

It is another object of the subject invention to provide a new and improved hair roller which may be utilized to produce a naturally curly hair style without requiring a variety of roller sizes.

SUMMARY OF THE INVENTION

In accordance with these and many other objects, the subject invention provides a new and improved roller for producing curls in a strand of hair. More particularly, a hair roller is disclosed which may be utilized to produce curls of various curvatures along the length of a single strand of hair. The subject hair roller includes a longitudinally extending body having a non-uniform cross section around which a strand of hair may be wrapped. In use, a strand of hair is wrapped around the body in a helical manner along its length such that the diameter of successive turns of the strand varies. Preferably, a means is provided for maintaining the strand in a fixed position relative to the body, for the desired period of time. As pointed out above, the curvature of the curls produced by a roller corresponds to the diameter of the roller around which it has been wrapped. Accordingly, when the strand is unwound from the subject roller having a non-uniform cross section, the curls produced will have a variety of curvatures along the length of the strand. A plurality of identical rollers of the subject invention may be used throughout the hair to create a naturally curly hair style.

In the preferred embodiment of the subject invention, the longitudinally extending body is defined by an intermediate solid member having an oblate spheroid configuration. Two sets of rods extend axially away from the opposed ends intermediate member. Each set of rods terminates in a flange portion provided to prevent the hair from inadvertently slipping off the ends of the roller. Each set of rods includes at least three distinct rod members and are spaced apart in a manner to define an essentially cylindrical configuration having a circular cross-section. The diameter of the circular cross section defined by each set of rods is less than the maximum cross-sectional diameter of the intermediate solid member.

Further objects and advantages of the subject invention will become apparent from the following detailed description when taken in conjunction with the drawings in which:

DESCRIPTION OF THE PREFERRED EMBODIMENT

Figure 1:
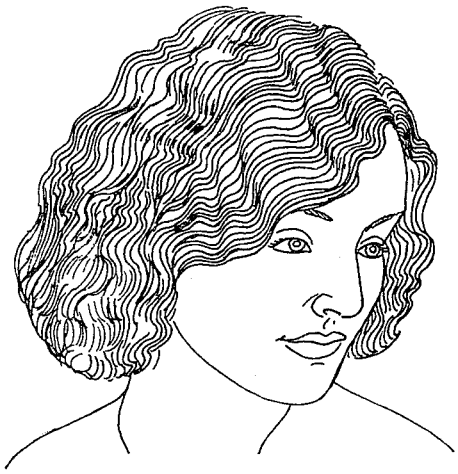
FIG. 1 is a perspective view of a person illustrating the naturally curly appearance which can be achieved using the new and improved hair curling device of the subject invention.

In FIG. 1 there is illustrated a person having a naturally curly hair style which can be achieved utilizing the new and improved roller of the subject invention. It is to be noted that individual strands of hair are provided with curls having various curvatures along its length.

Figure 2:
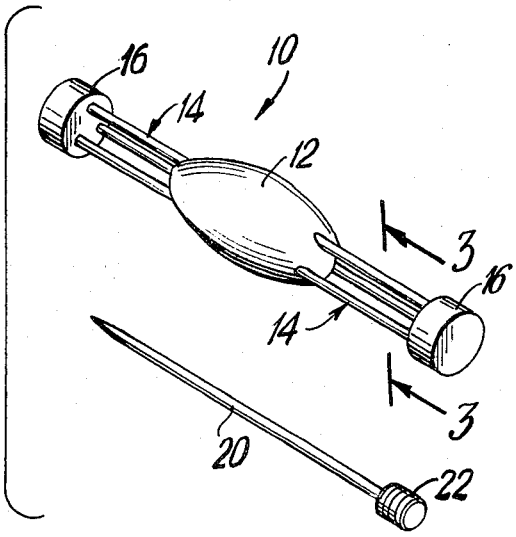
FIG. 2 is an exploded perspective view of the new and improved hair curling device of the subject invention.
Figure 3:
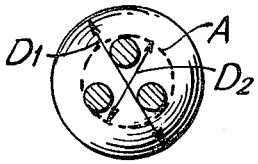
FIG. 3 is a cross sectional view, taken along the line 3—3 in FIG. 2, of the new and improved hair curling device of the subject invention.

Referring to FIGS. 2 and 3, there is illustrated the new and improved hair roller 10 of the subject invention. The hair roller 10 includes a longitudinally extending body having non-uniform cross sectional diameter. More particularly, the body is defined by an intermediate solid member 12 having a generally oblate spheroid configuration. The body of the subject roller 10 further includes two sets of projecting rods 14 extending axially away from the opposed ends of the solid member 12. Each set of rods terminates in a pair of opposed flanges 16 which are provided to inhibit a strand of hair from slipping off the ends of the roller.

In the preferred embodiment of the subject invention, each set of rods 14 are spaced apart in a manner to define a generally cylindrical configuration having a circular cross section. More particularly, and as illustrated in FIG. 3, rods 14 are spaced apart to define a generally circular diameter illustrated in phantom lines at A. Preferably, at least three rods 14 are provided in order to achieve a more circular cross section.

In accordance with the subject invention, the cross-sectional diameter of the subject roller 10 is non-uniform along its length. In the preferred embodiment, the maximum cross section D1 is located at the center of the intermediate solid body 12. The maximum diameter D1 is more particularly illustrated in FIG. 3. As illustrated in FIG. 2, the intermediate body 12 is tapered towards the opposed ends thereof such that the cross-sectional diameter gradually lessens towards the ends. The location and spacing of each set of rods 14 defines the cross sectional diameter D2 of the remainder of the roller 10, as illustrated in FIG. 3.

The provision of the spaced apart, axially projecting rods 14 in the subject roller 10, facilitates the maintenance of the hair in a fixed position relative to the body after it has been wound around the roller. More particularly, the plurality of rods 14 defines a spaced matrix through which a pin 20, as illustrated in FIG. 2, may be inserted. As described more fully hereinbelow, after a strand of hair has been wound around the roller 10, the pin 20 may be inserted through the spaced apart rods for maintaining the strand in a fixed position relative to the roller. Preferably, pin 20 includes a thickened head portion 22 to facilitate the handling of the pin.

Figure 4:
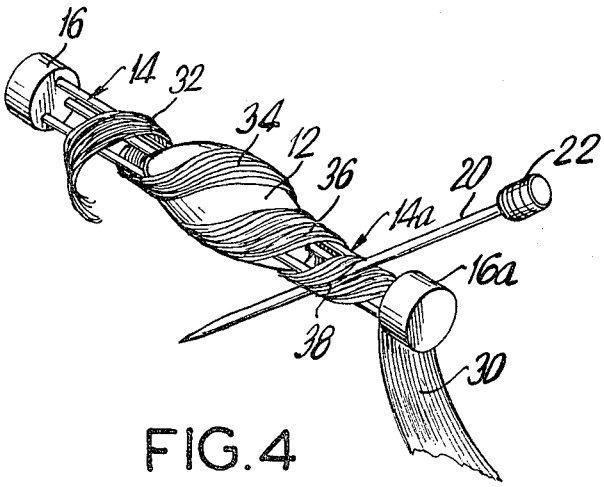
FIG. 4 is a perspective view illustrating a strand of hair wrapped around the new and improved hair curling device of the subject invention.

In order to utilize the roller 10 of the subject invention, a user will first separate their hair into groups or strands 30. One strand 30 may then be wound around the roller 10 in a helical manner along the length thereof, as illustrated in FIG. 4. In FIG. 4, there are illustrated four helical turns around the body, extending from one flange 16 to the opposed flange **16*a*. Only four turns have been illustrated for the purposes of clarity, however, it is to be understood that any number of turns may be provided as desired. For example, the number of turns may be increased by spacing the turns closer together or even by overlapping some of the turns. With relatively long hair, it may be desirable after winding towards flange 16*a*, to reverse direction and continue winding back towards flange 16**.

Referring to FIG. 4, it will be seen that the first turn 32, adjacent flange 16, is wrapped around first set of rods 14 having a cross sectional diameter D2, as illustrated in FIG. 3. The second turn 34 passes over one end of the intermediate solid member 12 and extends towards the center thereof. By this arrangement, the diameter of turn 34 gradually increases to equal the diameter D1 of member 12. In contrast, the diameter of third turn 36 gradually decreases as it approaches the second set of rods **14*a*. As can be appreciated, the diameter of fourth turn 38, which is wound around the second set of rods 14*a*, has a diameter D2 approximately equal to the first turn 32**.

Pin 20 is utilized to maintain the hair in a fixed position relative to the roller 10 until it is desired to unwind the hair. More particularly, pin 20 is inserted through the strand of hair 30 and extends through a set of spaced apart rods **14*a* in order to hold the hair. As pointed out above, flanges 16 and 16*a* also aid in maintaining the hair on the roller 10 by inhibiting strands from falling off the ends of the roller 10**.

Figure 5:
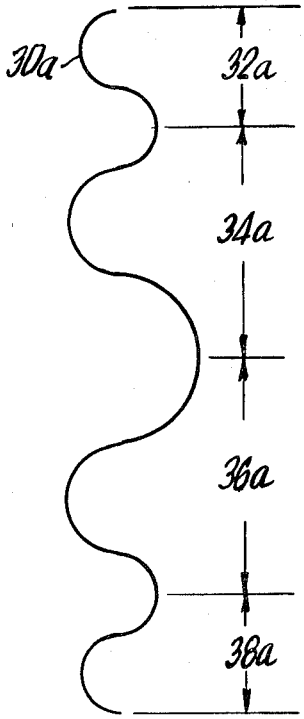
FIG. 5 is a schematic illustration depicting the variable curvature of the strand of hair which can be achieved using the new and improved hair curling device of the subject invention.

The unique styling effect which can be achieved utilizing the subject roller 10 on hair is schematically illustrated in FIG. 5. More particularly, and as discussed above, the curvature imparted to the hair by a roller corresponds to the diameter of the roller. Accordingly, the first turn of a strand **30*a* of hair wound in a manner similar to strand 30 in FIG. 4, will have a relatively small curvature as shown at area 32*a*, illustrated in FIG. 5. The second turn of strand 30*a* will be formed with a gradually increasing curvature as shown at area 34*a* in FIG. 5. Third turn of strand 30*a*, which is wrapped around a portion of hair roller 10 that decreases in diameter, will have a curvature which correspondingly decreases, as illustrated at 36*a*. Finally, the fourth turn, which is wrapped around the second set of rods 14*a*, will have a curvature shown at 38*a* substantially conforming to the curvature 32*a*** of the first turn.

FIGS. 4 and 5 demonstrate the effect which can be achieved by wrapping a single strand of hair around one roller 10 of the subject invention. In order to create a hair style as illustrated in FIG. 1, a plurality of rollers 10 are utilized. The user's hair is divided into a plurality of strands, each strand being wrapped around a single roller in a helical manner, as illustrated in FIG. 4. When the hair strands are unwrapped from all the rollers, after a suitable time period, a naturally curly hair style can be achieved. More particularly, instead of providing individual strands with curls having a constant curvature, as achieved by using the prior art rollers, each individual strand is formed with curls having various curvatures. By this arrangement, the naturally curly style can be achieved. In addition, since only one size roller need be used, the requirement of providing a variety of different sized rollers, as in the prior art, is eliminated thereby reducing costs and simplifying their use.

The subject hair rollers 10 are intended to be used in conjunction with conventional styling techniques. For example, home users typically will initially wash their hair and wrap the strands around the roller while still wet. When the hair is fully dried the strands can be unrolled. This technique tends to produce curls which last for a relatively short duration, on the order of one day. In the alternative, various chemical solutions may be added to the hair to insure that the curling effect, imparted by the roller 10, will be more permanent. In accordance with conventional techniques, a permanent solution can be added either prior to or after the hair has been wound around the roller.

In summary, there is provided a new and improved device for imparting curls to the hair. More particularly, a roller is disclosed capable of forming curls having various curvatures along a single strand of hair. The subject roller includes a longitudinally extending body having a non-uniform cross section. The body is defined by intermediate solid member 12 having a generally oblate spheroid configuration. Two sets of axially extending rods 14 project outwardly from the opposed ends of the intermediate solid body 12, each set terminating in a flange portion 16. Preferably, each set of rods 14 is spaced apart in a manner to define an essentially cylindrical configuration having a circular cross section with a diameter D2 less than the maximum diameter D1 of the intermediate body. In use, a strand of hair is wound around the body of the roller 10 in a helical manner such that the diameter of successive turns of the strand varies. Preferably, a means is provided for maintaining the strand in a fixed position relative to the body for as long as desired. When the strand is unwound from the body, curls having various curvatures will be formed along the length of the strand. The roller 10 of the subject invention enables the user to achieve a more naturally curly hair style.

While the subject invention has been described with reference to a preferred embodiment it is apparent that various modifications and changes can be made therein by one skilled in the art without varying from the scope and spirit of the subject invention as defined by the appended claims.

What is claimed is:

1. A device for imparting curls to a strand of hair comprising:

a longitudinally extending body around which said strand of hair may be wrapped, said body having a non-uniformed cross section along its length, said body including an intermediate member having a generally oblate spheroid configuration, and a pair of generally cylindrical portions extending axially away from the opposed ends of said intermediate member, said generally cylindrical portions each having a cross sectional diameter less than the cross sectional diameter of said intermediate member; and means for maintaining said strand of hair in a fixed position relative to said body, whereby in use said strand of hair is wound around said body in a helical manner along the length of said body, said hair being affixed to said body by said maintaining means such that the diameter of successive turns of said strands varies and such that when said maintaining means is released and said strand is unwound from said body, curls having various curvatures will be formed along the length of said strand.

2. A hair curling device as recited in claim 1 wherein said intermediate member is a solid member and wherein said pair of generally cylindrical portions is defined by two sets of projecting rods extending axially away from the opposed ends thereof, the rods in each said set being spaced apart to define an essentially cylindrical configuration having a circular cross section, with each said set of rods terminating in a flange portion.

3. A hair curling device as recited in claim 2 wherein said maintaining means includes a pin adapted to be inserted between said projecting rods of one said set of projecting rods for maintaining said hair in a fixed position relative to said body.

4. A hair curling device as recited in claim 3 wherein the diameter of each said flange portion is greater than said cross-sectional diameter defined by each said set of rods, thereby aiding in preventing said hair from slipping off the opposed ends of said device.

5. A device for imparting curls to a strand of hair comprising:

a longitudinally extending body around which said strand of hair may be wrapped, said body having a non-uniform cross section along its length, said body being defined by an intermediate solid member having two sets of projecting rods extending axially away from the opposed ends thereof, with each said set of rods terminating in a flanged portion, each said set of rods being disposed in a circular array concentrically about the longitudinal axis of said body, the cross sectional area of said solid member taken perpendicular to the longitudinal axis of said body being greater than the cross sectional area defined by each said circular array defined by each said set of rods; and means for maintaining said strand of hair in a fixed position relative to said body, whereby in use said strand of hair is wound around said body in a helical manner along its length and affixed thereto with said maintaining means such that the diameter of successive turns of the strand varies, and such that when said maintaining means is released and said strand is unwound from said body, curls having various curvatures will be formed along the length of said strand.

6. A hair curling device as recited in claim 5 wherein said solid member is in the form of an oblate spheroid.

7. A hair curling device as recited in claim 5 wherein each said set of axially extending rods includes at least three distinct rods spaced apart in a manner to define an essentially cylindrical configuration having a circular cross-section, with the diameter of said cross-section, defined by each said set of rods, being less than the maximum cross-sectional diameter of said solid members.

8. A hair curling device as recited in claim 7 wherein the diameter of each said flange portion is greater than said cross-sectional diameter defined by each said set of rods, thereby aiding in preventing said hair from slipping off of the opposed ends of said device.

* * * * *